US005977849A

United States Patent [19]

Hsing et al.

[11] Patent Number: 5,977,849

[45] Date of Patent: Nov. 2, 1999

[54] VARIABLE TOPOGRAPHY ELECTROMAGNETIC WAVE TUNING DEVICE, AND OPERATING METHOD

[75] Inventors: Ching-yuan L. Hsing, West Hills; John E. Jordan, Rancho Palos Verdes; Paul J. Tatomir, Laguna Niguel, all of Calif.

[73] Assignee: Huhges Electronics Corporation, El Segundo, Calif.

[21] Appl. No.: 08/898,134

[22] Filed: Jul. 22, 1997

[51] Int. Cl.[6] ..... H01P 7/06

[52] U.S. Cl. ..... 333/232; 333/233; 333/235

[58] Field of Search ..... 333/209, 222–235

[56] References Cited

U.S. PATENT DOCUMENTS

| | | | |
|---|---|---|---|
| 2,409,321 | 10/1946 | Stephan | 333/229 |
| 2,486,129 | 10/1949 | De Walt et al. | 333/229 |
| 3,020,500 | 2/1962 | Beiser | 333/226 |
| 3,121,205 | 2/1964 | Foss | 333/233 |
| 3,222,564 | 12/1965 | De Pue, Jr. et al. | 333/229 X |
| 3,873,949 | 3/1975 | Dorsi et al. | 333/234 |
| 4,677,403 | 6/1987 | Kich | 333/229 |
| 5,309,129 | 5/1994 | Arnold et al. | 333/234 X |
| 5,420,554 | 5/1995 | Gehrke | 333/219 X |

FOREIGN PATENT DOCUMENTS

| | | | |
|---|---|---|---|
| 4113302 A1 | 10/1992 | Germany | 333/229 |

OTHER PUBLICATIONS

Nishikawa et al, "800 $MH_z$ Band Dielectric Channel . . . Resonance", 1985 IEEE MTT–S Int. Microwave Sympo. Digest, Jun. 4–6, 1985, pp. 289–292.

*Primary Examiner*—Seungsook Ham
*Attorney, Agent, or Firm*—Georgann S. Grunebach; M. W. Sales

[57] ABSTRACT

An electromagnetic wave component uses one or more diaphragms secured to the interior of a waveguide structure to tune its resonant frequency, with each diaphragm engaged by one or more adjustment members that deform it. The adjustment members are preferably screws that are threaded through the structure to push and/or pull on the diaphragms, thereby tuning the electromagnetic wave component. The shift in the resonant frequency of the electromagnetic wave component due to temperature-induced dimensional changes is mitigated if the materials used for the diaphragm, the adjustment members and the structure which houses the diaphragm are chosen to have an appropriate combination of thermal coefficients of expansion.

7 Claims, 3 Drawing Sheets

VARIABLE TOPOGRAPHY ELECTROMAGNETIC WAVE TUNING DEVICE, AND OPERATING METHOD

BACKGROUND OF THE INVENTION

1. Field of the Invention

This invention relates to electromagnetic wave components whose resonant frequency band can be tuned, especially components for microwaves and radio frequencies.

2. Description of the Related Art

Electromagnetic wave components are widely used in research and industry, especially for communications in the microwave region. Their physical dimensions determine which frequencies and modes will propagate through them, and filters can be constructed to eliminate unwanted frequencies. However, it is often necessary to tune an electromagnetic wave component, such as a cavity, filter, or coaxial resonator, so that it responds precisely to a particular frequency of interest. For example, the resonant frequency or frequencies of a component will change with temperature, since the component will expand or contract in accordance with its thermal coefficient of expansion, thereby varying the frequencies supported by the cavity. A component's temperature can significantly increase due to thermal effects resulting from its operation.

An electromagnetic wave component is frequently tuned with screws that penetrate through its walls into its interior where the screws interact with propagating electromagnetic waves, especially with their electric field component, to vary the allowed frequencies of propagation. This technique is illustrated by T. Nishikawa, K. Wakino, H. Wada and Y. Ishikawa in "800 MHZ Band Dielectric Channel Dropping Filter Using $TM_{110}$ Triple Mode Resonance," 1985 *IEEE MTT-S International Microwave Symposium Digest,* Jun. 4–6, 1985, pp. 289–292, St. Louis, Mo. Tuning screws are generally metal, since dielectrics tend to dissipate microwave energy. They are sometimes fitted with an object such as a disc on their end, in order to increase the effective surface area.

"Orthogonal tuning screws" are screws positioned in line with the electric field components of the electromagnetic wave component's two orthogonal modes. Typically, each of the two orthogonal modes will have its own set of screws, so that the modes can be tuned independently of each other. Other screws not perpendicular to the orthogonal tuning screws are often used to vary the degree of coupling between the two orthogonal modes. FIG. 1 shows a dispersion relation 10 that represents the transmission through an electromagnetic wave component in the absence of any screws. The resonant frequency band is shifted when screws penetrate into the component's interior, as represented by dispersion relation 12.

The use of screws has a number of shortcomings, however. For one, screws are limited in the extent to which they can tune a system because of their small surface area. Also, disruptions of the electromagnetic field at metal-to-metal contact points (e.g. where the screw enters the cavity) can lead to the passive intermodulation (PIM) problem in high power devices. For this reason, the mechanical tolerances of the screws and their holes must be kept tight, and an additional filter must be frequently added to such a system to eliminate unwanted frequencies. Most importantly, the use of screws leads to turbulence in the electromagnetic waves, resulting in resistive losses. In general, turbulence can be expected in any system in which the electromagnetic waves encounter edges or protrusions.

Tuning blocks, which are metallic or dielectric "buttons" secured with adhesive onto an interior wall of an electromagnetic wave component, suffer in general from the same problems as screws. To circumvent the problems associated with screws or buttons, pliers are sometimes used to deform an electromagnetic wave component, as for example in the procedure known as "dent tuning." That is, when the walls of the component are deformed, the modes it supports are altered. However, it is difficult to reverse the damage done to a structure that has been dented, and the degree of tunability offered by this procedure is highly dependent upon the user's experience.

To mitigate drifts in their resonant frequency or frequencies due to changes in temperature, electromagnetic wave components are often constructed from alloys such as nickel-steel which are temperature-stable but expensive and heavy. Even so, these alloys do not offer a complete solution to the problem of frequency drift, since the resonant frequency of such devices still drifts by as much as several tenths of a percent over typical operating conditions. A temperature compensating waveguide resonator is described in U.S. Pat. No. 4,677,403 to Kich which partially compensates for drifts in the resonant frequency arising from thermal expansion or contraction of the resonator, but it does not allow for active tuning.

SUMMARY OF THE INVENTION

The present invention is an electromagnetic wave component, such as a cavity, filter or coaxial resonator, whose resonant frequency can be tuned. It includes one or more flexible diaphragms that are secured to an electromagnetic waveguide structure and interact with propagating electromagnetic radiation. Pressure is exerted on each diaphragm by one or more adjustment members that control its shape and the extent to which it protrudes into the component, thereby tuning the component to the desired resonant frequency.

The adjustment members are preferably screws that are threaded through the structure to exert pressure on the diaphragm at various points. They are preferably secured to the diaphragm itself so that it can be either pushed into or pulled away from the interior of the component.

Although the resonant frequency of an electromagnetic wave component generally shifts due to temperature-induced dimensional changes, this problem is mitigated in some embodiments of the current invention if the materials used for the diaphragm, the waveguide structure which houses the diaphragm, and the adjustment members are chosen to have an appropriate combination of thermal coefficients of expansion. Materials can also be injected between the diaphragm and the waveguide structure to control or affect the thermal characteristics of the electromagnetic wave component.

Further features and advantages of the invention will be apparent to those skilled in the art from the following detailed description, taken together with the accompanying drawings.

DETAILED DESCRIPTION OF THE INVENTION

Figure 2:
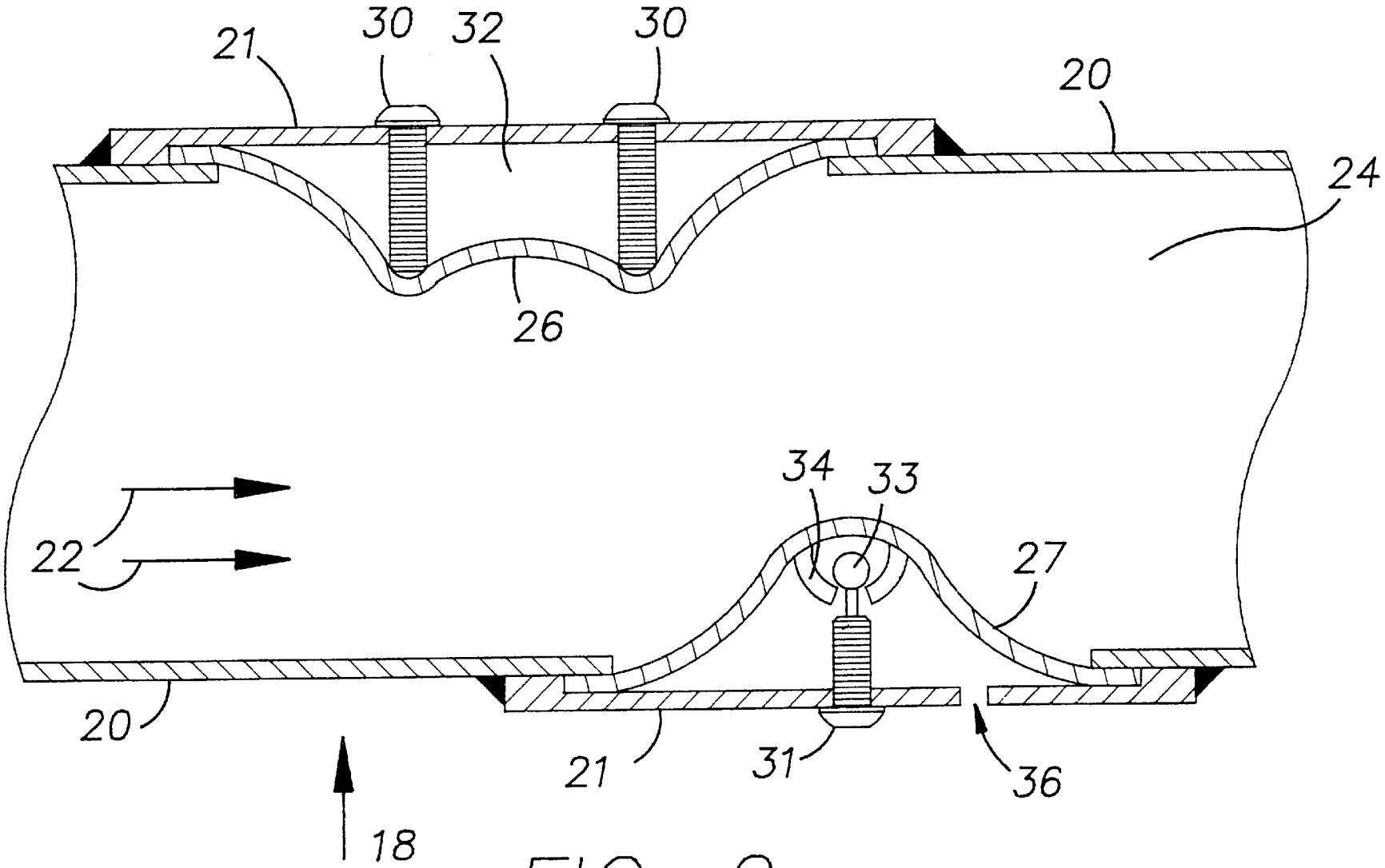
FIG. 2 is an illustrative sectional view of one embodiment of the invention in which an electromagnetic wave component is tuned with one or more diaphragms.

As shown in the accompanying drawings, the present invention is an electromagnetic wave component whose resonant frequency or frequencies can be tuned. The invention can be used with active and passive radio frequency and microwave components and transmission lines, as well as with waveguide components designed for TEM waves such as coaxial resonators. FIG. 2 shows part of an electromagnetic waveguide structure 18 that includes one or more walls 20 and supports the propagation of electromagnetic radiation 22 that passes through the interior 24 of the waveguide structure. Typical shapes for the waveguide structure 18 include cylinders, spheres and rectangular cavity resonators.

A flexible diaphragm 26 or other flexible component that is preferably smoothly contoured to mitigate electromagnetic turbulence is secured to a support member 21 such as a plate, in which the support member is preferably welded to wall 20 and is part of the electromagnetic waveguide structure 18, i.e. the diaphragm passes through a hole in wall 20. Alternatively, the diaphragm 26 can be secured directly to the inside of wall 20. The diaphragm 26 interacts with the electromagnetic radiation 22 to alter the resonant frequency of the device and is preferably secured at a point near a peak of the electric or magnetic field, so that the tuning sensitivity is enhanced. The diaphragm 26 preferably makes electrical contact with one of the walls 20 and is preferably a conductor such as 0.5–1" wide circular or square pieces of Al, Mg or BeCu alloy having a thickness of several electromagnetic wave skin depths; in addition, it preferably makes a mechanically sound interface with the waveguide structure 18 to mitigate generation of passive intermodulation. A dielectric, a ferrite or a ferroelectric material, or alternatively, a rubber-like material that has been impregnated with any one of these substances may also be used. The material used depends upon the application at hand. In the case of capacitive tuning, for example, a metal is typically used when the electric field is normal to the wall 20, but a dielectric is preferred when the electric field is parallel to the wall. The extent to which diaphragms are typically deformed has been exaggerated in all of the figures for the purpose of illustration.

How diaphragm 26 is secured to its support member 21 depends upon the diaphragm's construction, but may involve one of a number of techniques including welding, soldering, or attaching it with springs or clamps which themselves are joined to the support member. The diaphragm 26 is preferably secured to the support member 21 all around the diaphragm for high power applications where the PIM problem might be a concern, but securing the diaphragm at several spots may suffice for low power applications.

Diaphragm 26 is flexible, i.e. its shape changes when force is exerted against it, preferably by one or more screws 30 or other solid adjustment members such as rods or wires with which it is in contact. By exerting force on the diaphragm 26, the screws 30 control the shape of the diaphragm and the extent to which it protrudes into the waveguide structure's interior 24, thereby altering the internal topography of the device and effectively tuning it. The diaphragm 26 is preferably resilient enough that it returns to its original shape when the screws 30 are withdrawn from the diaphragm. Because of its smooth contour, the diaphragm 26 mitigates the electromagnetic turbulence that would otherwise be encountered if objects with edges (such as screws) were directly used to tune the electromagnetic wave component. Likewise, use of the diaphragm 26 or other smoothly contoured flexible component mitigates any PIM problem when properly secured to the electromagnetic wave component.

The screws 30 are preferably threaded into holes in the support member 21 and push against the diaphragm 26 when their heads are rotated in one direction; when more than one screw is used, they can be placed in a linear or two dimensional arrangement with respect to the diaphragm. Alternatively, the adjustment member can be a gas, liquid or other substance that is added to or withdrawn from the space 32 between the support member 21 and the diaphragm 26, in which case the pressure exerted against the diaphragm is preferably controlled by pumps and gauges external to the waveguide structure 18. However, this arrangement requires that the entire periphery of the diaphragm 26 be carefully sealed to the support member 21 to prevent unwanted leakage of the substance into the waveguide structure 18.

Alternatively, a screw 31 or other adjustment member can be secured to a flexible diaphragm 27 or other preferably smoothly contoured flexible component so that the diaphragm can be either pushed into or pulled away from the waveguide structure's interior 24. One way to accomplish this is to fit screw 31 with a ball 33 that is captured within a cup 34 attached to the diaphragm 27. Screw 31 and diaphragm 27 are otherwise like their counterparts screw 30 and diaphragm 26. As screw 31 is withdrawn from the waveguide structure's interior 24, its ball 33 pulls the diaphragm 27 with it, allowing the diaphragm to be more accurately positioned and thereby permitting the electromagnetic wave component to be more precisely tuned.

Once the electromagnetic wave component has been tuned to the user's satisfaction, the position of diaphragm 27 can be fixed by injecting an adhesive such as an epoxy through a hole 36 in the support member 21, provided that the entire periphery of the diaphragm has been sealed to the support member to prevent leakage. To enable greater tunability of the device, multiple screws 30 (or 31) can be used to contact different points of diaphragm 26 (or 27), and more than one diaphragm may be used at different locations within the waveguide structure 18. The relatively massive screws 30 (or 31) can then be removed.

Figure 1:
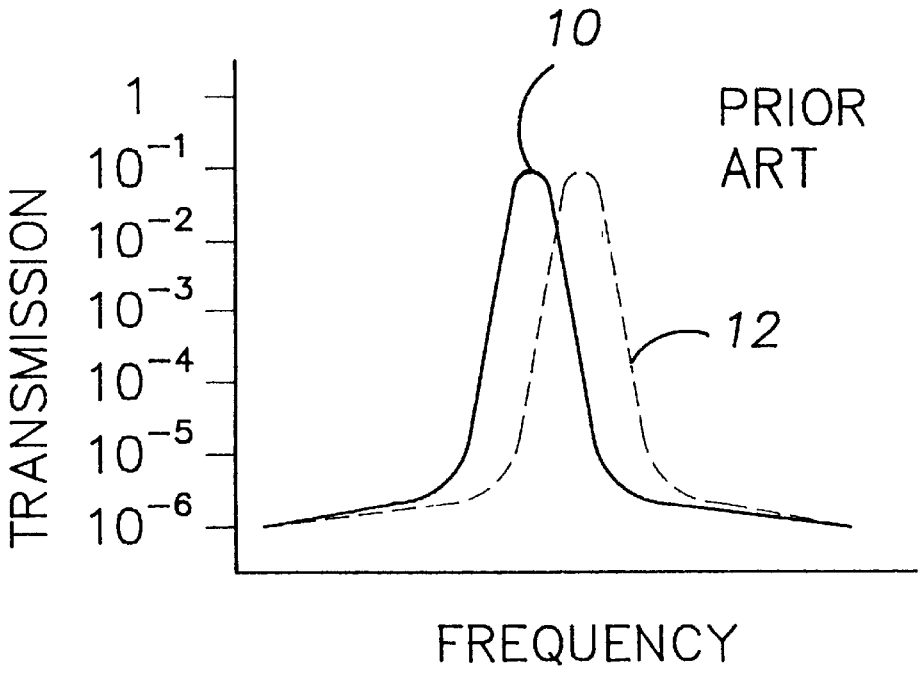
FIG. 1 is a graph illustrating how the dispersion relation of a typical electromagnetic wave component is changed by tuning it with a screw.
Figure 3:
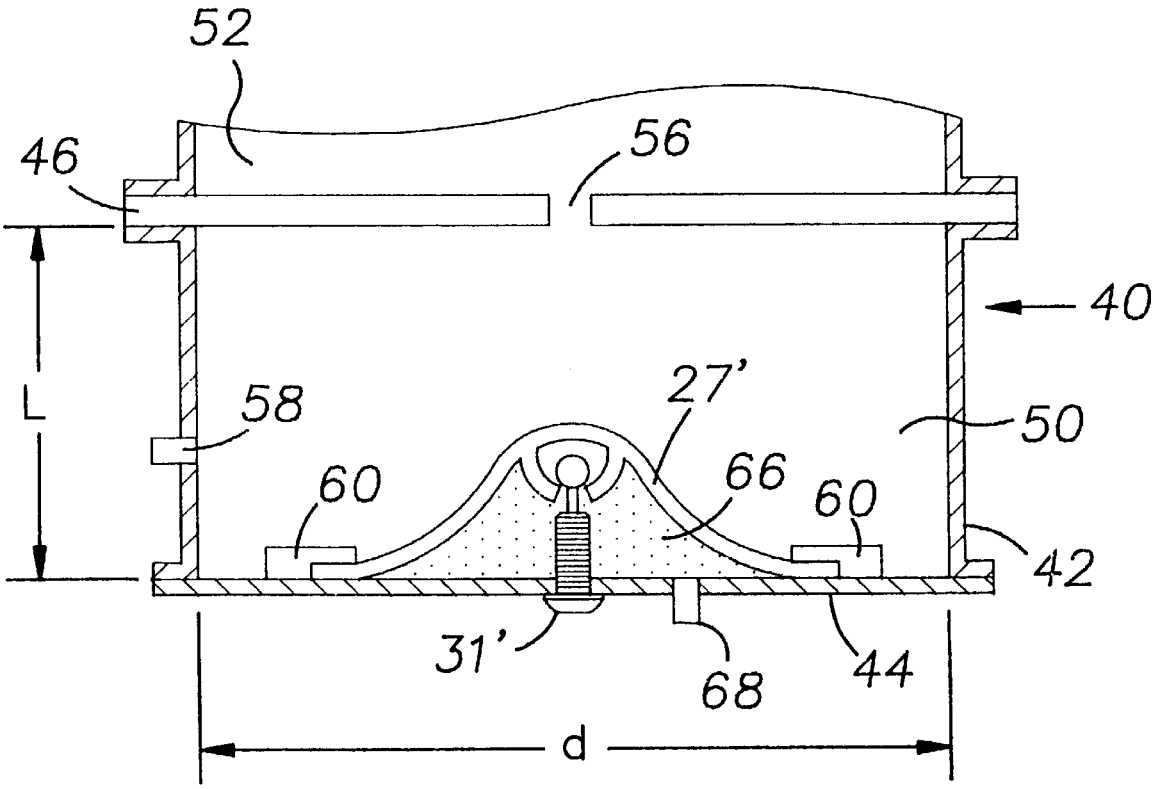
FIG. 3 is an illustrative sectional view of another embodiment in which shifts in an electromagnetic wave component's resonant frequency resulting from temperature dependent dimensional changes are mitigated.

FIG. 3 shows a tunable, temperature compensated electromagnetic wave component, shown by way of example as a cavity resonator 40 that includes a tubular sidewall 42 and a pair of endwalls 44 (only one of which is shown) at opposite ends of the sidewall. The resonator 40 includes a generally circular, flat coupling iris 46 that divides it into two cavities 50 and 52. The coupling iris 46 effectively acts as an endwall member that, together with endwall 44, defines the axial dimension of cavity 50. The coupling iris 46 preferably includes a cross-shaped slot 56 that couples electromagnetic energy from cavity 50 into cavity 52. Since the resonant frequencies of cavities 50 and 52 may be different, coupling iris 46 permits the resonator 40 to exhibit two selected resonant frequencies, as determined by the respective lengths and diameters of the cavities 50 and 52. Resonator 40 further includes an input coupler 58 for electromagnetic radiation into cavity 50, as well as an output coupler (not shown) from cavity 52. A diaphragm 27' or other flexible component is secured to the endwall 44 (this can be done with clamps 60 as shown in FIG. 3 or by securing the diaphragm to a separate support member as in FIG. 2), and a screw 31' or other adjustment member controls the extent to which the diaphragm protrudes into the cavity 50. Diaphragm 27' and screw 31' are used to tune cavity 50 and function like their counterparts diaphragm 27 and screw 31 of FIG. 2, respectively.

An increase in temperature will cause thermal expansion of the resonator 40, leading to downward shifts in the resonant frequencies of cavities 50 and 52, since the resonant frequency of a cavity is a function of its dimensions. Specifically, the resonant frequency increases with decreasing cavity length in the axial direction and decreasing transverse cavity dimension, as is well known.

This effect can be mitigated, however, by the diaphragm 27' and its screw 31' or other adjustment member, provided they have the proper thermal coefficients of expansion. For example, if the diaphragm 27' and its screw 31' have coefficients of expansion that are greater than that of sidewall 42 (endwall 44 and the sidewall are preferably the same material), the diaphragm and the screw will expand faster than the rest of the resonator 40, and thereby reduce the effective increase in the resonator's axial length that arises from an increase in temperature. This in turn will at least partially offset the lowering of the resonant frequency that would be observed if the diaphragm and its adjustment member had the same temperature coefficient of expansion as the sidewall.

The thermal coefficient of expansion of screw 31' can be chosen to match that of diaphragm 27', so that the screw and diaphragm expand and contract together uniformly. Alternatively, one or more screws 31' having a thermal coefficient of expansion greater than that of the diaphragm 27' and sidewall 42 may be used to enhance the expansion of the diaphragm during a rise in temperature, thereby mitigating the decrease in resonant frequency. A similar effect may be obtained by injecting a filler material 66 having the appropriate thermal coefficient of expansion through a hole in the endwall 44 into the space between the diaphragm 27' and the endwall, and capping the endwall with a plug 68.

Figure 4:
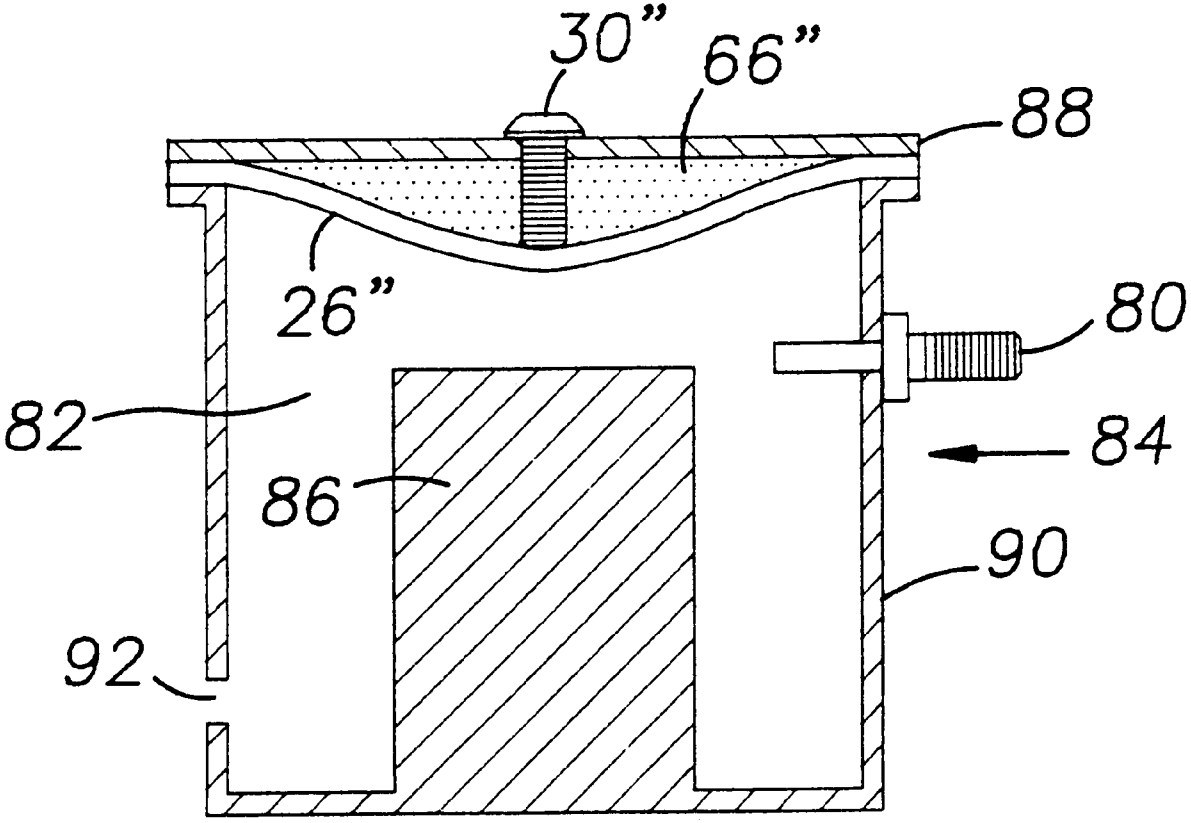
FIG. 4 is an illustrative sectional view of another embodiment in which a coaxial resonator is tuned with a diaphragm.

In FIG. 4, a connector 80, such as a TNC or SMA connector, introduces an electromagnetic field into a cavity 82 of a coaxial resonator 84. The coaxial resonator 84 includes a center conductor 86, an endwall 88, and one or more sidewalls 90. A hole 92 in the sidewall 90 couples the cavity 82 to another cavity (not shown). A diaphragm 26" or other flexible component is secured to the endwall 88, and a screw 30" or other adjustment member controls the extent to which the diaphragm protrudes into the cavity 82. Diaphragm 26" and screw 30" are used to tune cavity 82 and function like their counterparts diaphragms 26 and screw 30, respectively, i.e. the coaxial resonator 84 is tuned by the extent to which the diaphragm protrudes into the cavity. A filler material 66" like its counterpart 66 can be used to fix the diaphragm 26" in place, once the cavity 82 has been tuned.

While particular embodiments of the invention have been shown and described, numerous variations and alternate embodiments will occur to those skilled in the art. Accordingly, it is intended that the invention be limited only in terms of the appended claims.

We claim:

1. Tuning structure for interacting with electromagnetic radiation in an electromagnetic wave component that has at least one component wall, comprising:

a flexible diaphragm coupled to said component wall;

at least one adjustment member that is adjustably coupled to said component wall;

a first engagement member attached to one of said diaphragm and said adjustment member; and a second engagement member attached to the other of said diaphragm and said adjustment member and rotatably received by said first engagement member;

said diaphragm thereby having an adjustable position in said electromagnetic wave component for interaction with electromagnetic radiation.

2. The tuning structure of claim 1, wherein said diaphragm makes electrical contact with said component wall.

3. The tuning structure of claim 1, wherein said diaphragm comprises a material selected from a group consisting of a conductor, a dielectric, a ferrite and a ferroelectric.

4. The tuning structure of claim 1, wherein said adjustment member is a screw.

5. The tuning structure of claim 1, wherein said first engagement member is a cup and said second engagement member is a ball received in said cup.

6. The tuning structure of claim 1, wherein said adjustment member is secured to said diaphragm so that said diaphragm can be pulled away from as well as pushed toward said component wall.

7. The tuning structure of claim 1, further including a support member positioned to facilitate coupling of said diaphragm to said component wall.

* * * * *